US008424444B2

(12) United States Patent
Johnson et al.

(10) Patent No.: US 8,424,444 B2
(45) Date of Patent: Apr. 23, 2013

(54) COUNTERMEASURE SYSTEMS INCLUDING PYROTECHNICALLY-GIMBALED TARGETING UNITS AND METHODS FOR EQUIPPING VEHICLES WITH THE SAME

(75) Inventors: Michael R. Johnson, Tucson, AZ (US); Brian J. Lukow, Vail, AZ (US)

(73) Assignee: Raytheon Company, Waltham, MA (US)

( * ) Notice: Subject to any disclaimer, the term of this patent is extended or adjusted under 35 U.S.C. 154(b) by 210 days.

(21) Appl. No.: 12/848,445

(22) Filed: Aug. 2, 2010

(65) Prior Publication Data

US 2012/0210863 A1 Aug. 23, 2012

(51) Int. Cl.
*F41H 5/007* (2006.01)

(52) U.S. Cl.
USPC ..... 89/36.17; 89/902; 102/405

(58) Field of Classification Search ..... 89/36.17, 89/902; 102/404, 405
See application file for complete search history.

(56) References Cited

U.S. PATENT DOCUMENTS 3,838,642 A * 10/1974 Shimberg ..... 102/404
4,979,444 A * 12/1990 Schoffl ..... 102/404
5,169,093 A * 12/1992 Schoffl ..... 244/149
7,077,049 B2 * 7/2006 Shumov et al. ..... 89/36.17

* cited by examiner

*Primary Examiner* — Stephen M Johnson
(74) *Attorney, Agent, or Firm* — Renner, Otto, Boisselle & Sklar, LLP

(57) ABSTRACT

Embodiments of a pyrotechnically-gimbaled targeting unit are provided. In one embodiment, the targeting unit includes a targeting unit housing, a countermeasure payload carried by the targeting unit housing, and a plurality of thrusters coupled to the targeting unit housing. The plurality of thrusters is configured to be selectively activated to rotate the targeting unit housing about first and second substantially orthogonal axes to provide controlled pointing of countermeasure payload prior to the deployment thereof. Embodiments of a countermeasure system including a pyrotechnically-gimbaled targeting unit are also provided, as are methods for equipping a vehicle with a countermeasure system of the type that includes at least one pyrotechnically-gimbaled targeting unit.

17 Claims, 5 Drawing Sheets

COUNTERMEASURE SYSTEMS INCLUDING PYROTECHNICALLY-GIMBALED TARGETING UNITS AND METHODS FOR EQUIPPING VEHICLES WITH THE SAME

TECHNICAL FIELD

The following disclosure relates generally to threat defense systems and, more particularly, to embodiments of a countermeasure system including at least one pyrotechnically-gimbaled targeting unit, as well as to methods for equipping a vehicle with such a countermeasure system.

BACKGROUND

Countermeasure system are deployed onboard tanks and other armored fighting vehicles to provide protection from projectiles, such as guided and unguided anti-tank missiles. In a general sense, countermeasure systems can be divided into two broad categories: passive countermeasure systems and active countermeasure systems (also commonly referred to as "Active Protection Systems" or "APSs"). Passive countermeasure systems attempt to disable, or least diffuse, incoming projectiles upon impact. As one well-known example of a passive countermeasure system, slat armor provides a rigid grid around an armored fighting vehicle, which may effectively crush an incoming projectile, disable the fusing mechanism thereof, or otherwise prevent optimal detonation from occurring. Additional examples of passive countermeasure systems include composite armor, reactive armor, and airbag-based countermeasure systems, such as the Tactical Rocket Propelled Grenade ("RPG") Airbag Protection System recently introduced by Textron Defense Systems.

In contrast to passive countermeasure systems, Active Protection Systems are designed to destroy or otherwise disable incoming projectiles prior to vehicle-projectile impact. Well-known examples of Active Protection Systems include the Soviet Drozd System, the Israeli Trophy System, and the Russian Arena System. By definition, Active Protection Systems provide a major advantage over passive countermeasure systems; i.e., when successful, an APS destroys or otherwise disables an incoming projectile at a distance from the armored fighting vehicle thereby minimizing the likelihood of damage to the vehicle and its crew. Several limitations have, however, deterred the widespread adoption of conventional Active Protection Systems. First, many conventional Active Protection Systems are undesirably costly to manufacture, deploy, and service. Second, conventional Active Protection Systems, such as the Russian Arena System, are often considerably bulky and heavy. Third, as are many passive countermeasure systems, Active Protection Systems are often unreliable at defeating multiple threats or tandem threats, such as Rocket Propelled Grenades carrying tandem-charge high explosive anti-tank warheads (e.g., RPG-27 and RPG-29). Fourth, many Active Protection Systems are capable of reliably defeating incoming projectiles only within a relatively limited spatial envelope and, consequently, do not provide full hemispherical threat protection. For example, the bulky, conical fragmentation warhead employed by the Soviet Drozd system is capable of reliably defeating threats only between elevations of approximately −6-20 degrees and approximately 40-60 degrees along the vertical and horizontal planes, respectively. Finally, as an especially significant limitation in modern combat scenarios, conventional Active Protection Systems are typically ineffective at defeating RPGs launched in close proximity to the APS-equipped armored fighting vehicle.

There thus exists an ongoing need to provide embodiments of a countermeasure system that overcomes many, if not all, of the above-described limitations. In particular, it would be desirable to provide embodiments of an active countermeasure system that is reliable, scalable, compact, relatively lightweight, modular, and relatively inexpensive to manufacture and deploy onboard armored fighting vehicles. It would also be desirable for embodiments of such a countermeasure system to provide full hemispherical protection against incoming threats, including multiple threats, tandem threats, and RPGs launched in close proximity to the host vehicle. Finally, it would also be desirable to provide embodiments of method for equipping a vehicle, such as an armored fighting vehicle, with such a countermeasure system. Other desirable features and characteristics of the present invention will become apparent from the subsequent Detailed Description and the appended Claims, taken in conjunction with the accompanying Drawings and this Background.

BRIEF SUMMARY

Embodiments of a pyrotechnically-gimbaled targeting unit are provided. In one embodiment, the targeting unit includes a targeting unit housing, a countermeasure payload carried by the targeting unit housing, and a plurality of thrusters coupled to the targeting unit housing. The plurality of thrusters is configured to be selectively activated to rotate the targeting unit housing about first and second substantially orthogonal axes to provide controlled pointing of countermeasure payload prior to the deployment thereof.

Embodiments of a countermeasure system are also provided. In one embodiment, the countermeasure systems includes a pyrotechnically-gimbaled targeting unit, a countermeasure payload carried by the pyrotechnically-gimbaled targeting unit, and a base launch unit from which the pyrotechnically-gimbaled targeting unit is configured to be launched prior to deployment of the countermeasure payload.

Embodiments of a method are further provided for equipping a vehicle with a countermeasure system of the type that includes at least one pyrotechnically-gimbaled targeting unit carrying a countermeasure payload. In one embodiment, the method includes the steps of mounting canted launch rack to the vehicle and securing a base launch unit containing the pyrotechnically-gimbaled targeting unit to the canted launch rack.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. As appearing herein, the phrase "pyrotechnically-gimbaled targeting unit" is utilized to describe a payload-deployment device including a plurality of thrusters or other pyrotechnic elements that can be selectively actuated to rotate the device about at least two substantially orthogonal axes to provide controlled pointing of the payload prior to deployment thereof. The substantially orthogonal axes preferably, but do not necessarily, extend through the approximate center of gravity of the pyrotechnically-gimbaled targeting unit.

Figure 1:
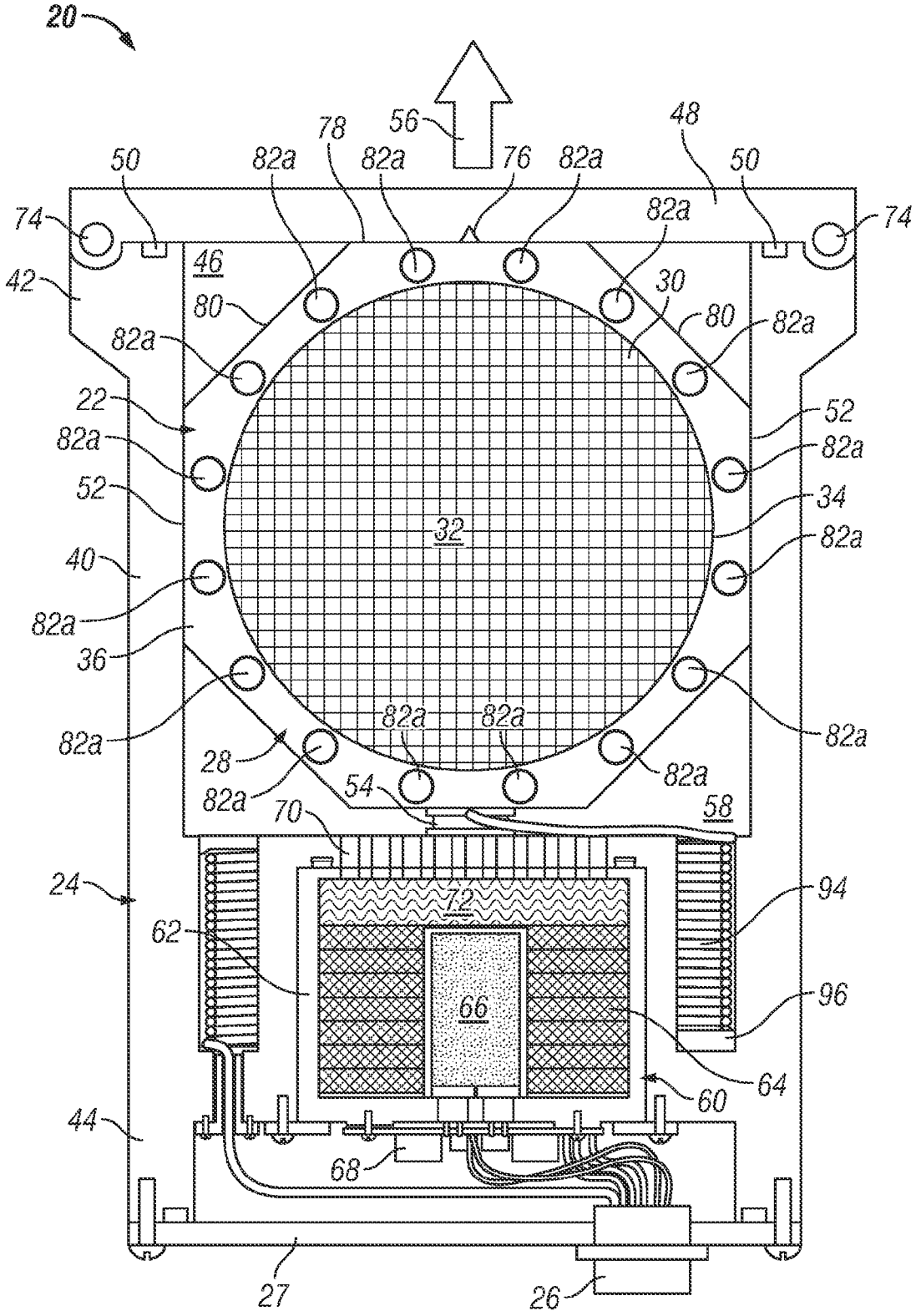
FIG. 1 is a front view of a countermeasure system including a pyrotechnically-gimbaled targeting unit and a base launch unit (shown in cutaway) in accordance with an exemplary embodiment.

FIG. 1 is a front view of a countermeasure system 20 including a pyrotechnically-gimbaled targeting unit 22 and a base launch unit 24 (shown in cutaway) in accordance with an exemplary embodiment. Countermeasure system 20 is especially well-suited for deployment onboard an armored fighting vehicle as an Active Protection System, which destroys or otherwise disables rocket propelled grenades and other incoming projectiles prior to vehicle impact. It is emphasized, however, that embodiments of countermeasure system 20 are by no means limited to deployment onboard armored fighting vehicles and may be deployed onboard or mounted to various other platforms, including other types vehicles (e.g., watercraft) and stationary structures. In certain embodiments, countermeasure system 20 may operate as a freestanding device, which can be emplaced by military personnel at selected ground-based deployment sites to provide, for example, ad-hoc protection of military personnel, buildings, supplies, or other assets. In such instances, countermeasure system 20 may be configured to operate autonomously or, instead, may be remotely controlled via wireless signal. Finally, although described below primarily as utilized to defeat rocket propelled grenades and other such projectiles, countermeasure system 20 can be utilized to destroy or disable various other types of threats and targets including, but not limited to, light-skinned armored fighting vehicles and low flying Unmanned Aerial Vehicles.

As illustrated in FIG. 1, an external connector 26 (e.g., a blind mate connector) is mounted through a lower wall 27 of base launch unit 24. When countermeasure system 20 is deployed onboard an armored fighting vehicle, external connector 26 engages a mating connector (not shown), which is coupled to an intercept timing system carried by the armored fighting vehicle (also not shown). The intercept timing system includes sensors deployed onboard the vehicle (e.g., an onboard radar system) configured to detect, and obtain vector data pertaining to, incoming missiles. Control circuitry included within the intercept timing system utilizes the vector data to determine the appropriate sequence and timing of actions that should be performed by countermeasure system 20 to defeat the incoming missile in the manner described below. Intercept timing systems that can be readily adapted for use in conjunction with countermeasure system 20 are well-known and have been implemented in conjunction with conventional Active Protection Systems of the type described above; consequently, a detailed description of an intercept timing system will not be provided herein.

Pyrotechnically-gimbaled targeting unit 22 includes a targeting unit housing 28 and a forward facing countermeasure payload 30, which is carried by targeting unit housing 28. Countermeasure payload 30 may assume the form of any warhead or other device, whether currently known or later developed, that can be deployed from targeting unit 22 to intercept, destroy, or otherwise neutralize a nearby threat, such as an incoming projectile. In a preferred embodiment, countermeasure payload 30 assumes the form of a shaped charge and, specifically, a Multiple Explosively Formed Projectile ("MEFP") warhead. For example, as indicated in FIG. 1, countermeasure payload 30 may comprise an MEFP warhead including a fragmentation liner 32, which is exposed through an opening 34 provided in a front face 36 of housing 28. An explosive (hidden from view in FIG. 1) is disposed within targeting unit housing 28 immediately behind fragmentation liner 32 and, when detonated, causes liner 32 to fragment into a number of high-velocity projectiles. Such high-velocity projectiles are well-suited for successively penetrating the shell of an incoming missile to destroy or otherwise disable the missile by, for example, damaging the missile's fusing mechanism. In one embodiment, fragmentation liner 32 is a monolithic metal (e.g., copper) sheet that is stamped with a multi-cell (e.g., honeycomb) pattern to promote the formation of high-velocity projectiles upon detonation of the MEFP warhead. Detonation of the MEFP warhead will also typically result in the destruction of targeting unit housing 28. Target unit housing 28 is thus conveniently formed from a lightweight plastic or similar material to minimize the production of high-energy debris emitted in the immediate vicinity of countermeasure system 20 during payload deployment.

Pyrotechnically-gimbaled targeting unit 22 is configured to be launched from base launch unit 24 immediately prior to deployment of countermeasure payload 30. As can be seen in FIG. 1, base launch unit 24 includes a canister body 40 having an open upper end portion 42, a closed lower end portion 44, and a storage compartment 46 in which pyrotechnically-gimbaled targeting unit 22 is stowed prior to launch. A canister lid 48 is disposed over open upper end portion 42 of canister body 40 to sealingly enclose storage compartment 46. Canister body 40 and canister lid 48 thus cooperate to impart countermeasure system 20 with a rugged, canisterized design, which protects the internal components of base launch unit 24 and pyrotechnically-gimbaled targeting unit 22 from damage during transport and soldier handling. By sealingly enclosing canister body 40, canister lid 48 also deters the ingress of sand, dust, and other debris into storage compartment 46 of countermeasure system 20, which may be mounted to the exterior of a tank or other armored fighting vehicle as described below. If desired, an environmental seal 50 (e.g., a rectangular gasket) can be disposed between canister lid 48 and open upper end portion 42 to further deter the ingress of dust and debris into storage compartment 46. Canister body 40 and canister lid 48 are each preferably fabricated from relatively durable metal or alloy, such as steel.

Targeting unit housing 28 is preferably shaped and sized to be matingly received within storage compartment 46. As the geometry and dimensions of targeting unit housing 28 will inevitably vary amongst different embodiments, so too will the geometry and dimensions of storage compartment 46. However, by way of example, targeting unit housing 28 may be imparted with a substantially octagonal geometry, as taken along an axis normal to front face 36 of targeting unit housing 28; and storage compartment 46 may be imparted with a generally rectangular shape, as taken along an equivalent axis. In such a case, targeting unit housing 28 includes opposing, substantially flat sidewalls 52, which slidably engage the inner, substantially flat sidewalls of storage compartment 46 during storage of targeting unit 22. The front and rear faces of targeting unit housing 28 likewise slidably engage the interior front and rear walls, respectively, of storage compartment 46 during targeting unit storage. Such a close-tolerance or mating fit between the exterior of targeting unit housing 28 and the interior walls of canister body 40 provides at least three advantages. First, such a mating fit maintains proper alignment of targeting unit housing 28 within storage compartment 46, which helps to ensure engagement of targeting unit 22 with an internal power connector 54 provided within storage compartment 46. Internal power connector 54 allows one or more energy storage devices (e.g., capacitors or batteries) included within targeting unit 22 to continually charge during targeting unit storage. Second, as pyrotechnically-gimbaled targeting unit 22 is launched from base launch unit 24, the outer circumferential walls of targeting unit housing 28 slide against the inner circumferential walls of canister body 40 to restrict the targeting unit's lateral movement and ensure that targeting unit 22 is reliably launched along a predetermined launch ray (represented in FIG. 1 by arrow 56). Finally, the close fit between targeting unit housing 28 and storage compartment 46 creates a circumferential seal around the interior of housing 28 to define a pressurizable launch chamber 58 within base launch unit 24, which allows targeting unit 22 to be propelled from base launch unit 24 utilizing a gas generator or other source of pressurized gas, as described more fully below.

With continued reference to the exemplary embodiment illustrated in FIG. 1, a source of pressurized gas is fluidly coupled to pressurizable launch chamber 58 and, upon actuation, directs a pressurized gas into chamber 58 to propel targeting unit 22 from base launch unit 24. Although other sources of pressurized gas may be utilized (e.g., pressure vessels containing a gas or gas mixture under high pressure), it is generally preferred that the source of pressurized gas assumes the form of a gas generator, such as gas generator 60 shown in FIG. 1. Gas generators suitable for usage as gas generator 60 are commonly utilized by the automotive industry within airbag deployment systems and have proven to be relatively inexpensive, reliable, and compact devices capable of rapidly producing significant gas pressures. This notwithstanding, additional embodiments of countermeasure system 20 may employ other types devices suitable for launching targeting unit 22 from base launch unit 24, such as compression springs and explosive devices.

In the exemplary embodiment illustrated in FIG. 1, gas generator 60 includes a casing 62, grain 64 (e.g., a stack of combustible wafers or pellets) disposed within casing 62, an initiator charge 66 embedded within grain 64, and initiator electronics 68 coupled to initiator charge 66. Initiator electronics 68 are, in turn, operably coupled to an intercept timing system (not shown) of the type described above. In particular, as shown in FIG. 1, initiator electronics 68 may be operably coupled (e.g., hardwired) to external connector 26, which engages a mating connector operably coupled to an intercept timing system onboard an armored fighting vehicle, as previously described. When commanded by the intercept timing system, initiator electronics 68 detonate initiator charge 66 to ignite grain 64 and generate pressurized gas flow. The pressurized gas produced by combustion of grain 64 flows from casing 62, through a plurality of flow ports 70 (only of which is labeled in FIG. 1), and into pressurizable launch chamber 58. As the gas pressure within pressurizable launch chamber 58 increases, so too does the force exerted by the gas on the lower exposed surfaces of pyrotechnically-gimbaled targeting unit 22. When a sufficient pressure is exerted on the lower surfaces of targeting unit 22, targeting unit 22 is propelled from base launch unit 24 in an upward direction (indicated in FIG. 1 by arrow 56). If desired, a mesh screen 72 can be mounted within casing 62 over ports 70, as shown in FIG. 1, to help capture any particles produced by detonation of initiator charge 66 or the burning of grain 64.

To enable targeting unit 22 to be launched in as rapid a manner as possible, canister lid 48 is preferably configured to enable pyrotechnically-gimbaled targeting unit 22 to be launched directly therethrough. For example, opposing sides of canister lid 48 may each be hingedly joined to open upper end portion 42 of canister body 40, as indicated in FIG. 1 at 74; and a score line 76 may be cut into the inner surface of a central portion of canister lid 48. When gas generator 60 is actuated, the pressurized gas within launch chamber 58 urges pyrotechnically-gimbaled targeting unit 22 upward against canister lid 48. When the force exerted on canister lid 48 by targeting unit 22 exceeds a predetermined break force, canister lid 48 fractures along score line 76 into two hinged halves. The two halves of lid 48 each swing outward from the centerline of canister body 40 as targeting unit 22 is propelled from storage compartment 46 and through open end portion 42 of base launch unit 22. Notably, due to its octagonal geometry, targeting unit housing 28 includes a substantially flat upper wall 78, which exerts a substantially even force over a central region of the underside of canister lid 48 to help ensure that lid 48 fractures substantially evenly along score line 76. In addition, the upper canted sidewalls 80 of targeting unit housing 28 will also urge the outward rotation of the two hinged halves of lid 48, if coming into contact therewith, to further facilitate the ejection of pyrotechnically-gimbaled targeting unit 22 from base launch unit 24.

Figure 2:
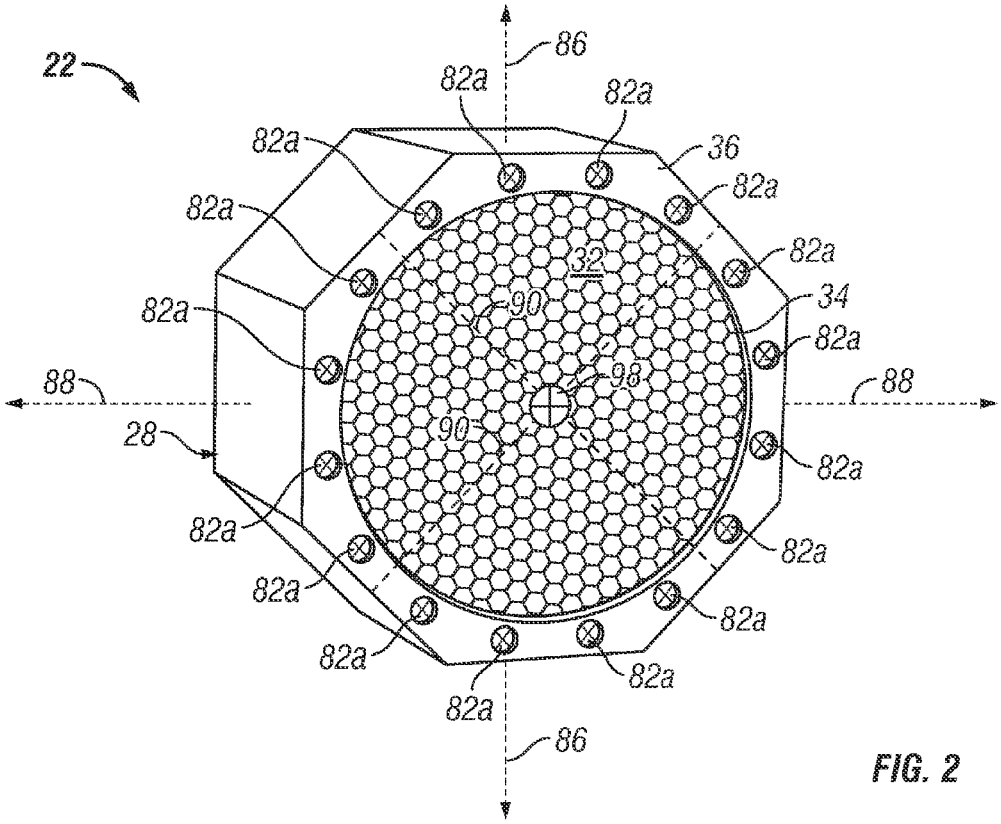
FIGS. 2 and 3 are front and rear isometric views, respectively, of the pyrotechnically-gimbaled targeting unit shown in FIG. 1.
Figure 3:
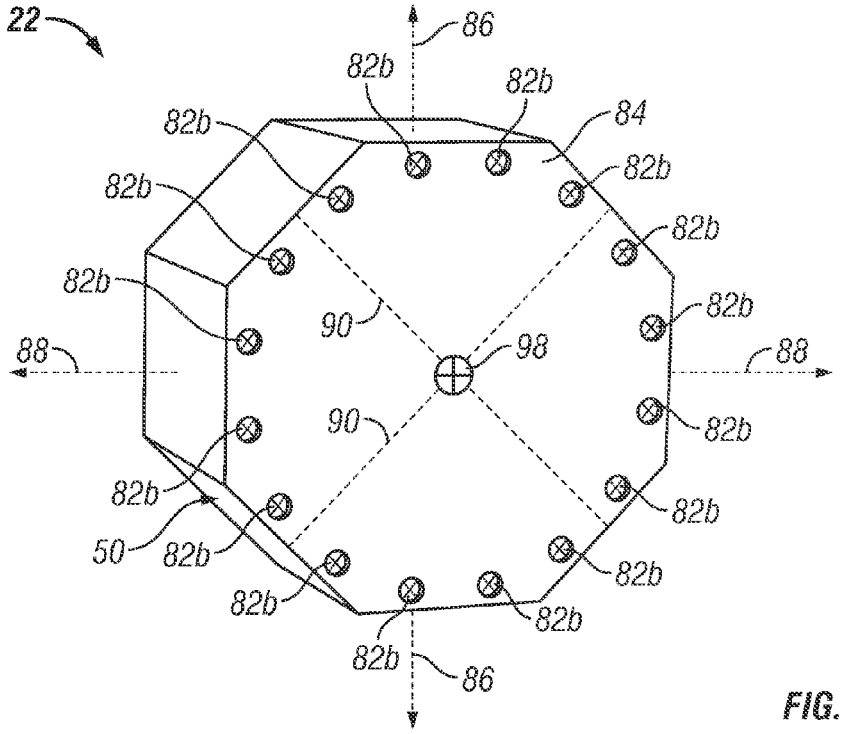

FIGS. 2 and 3 are front and rear isometric views, respectively, of pyrotechnically-gimbaled targeting unit 22. Referring collectively to FIGS. 1-3, targeting unit 22 further includes a plurality of pyrotechnic thrusters 82, which are mounted to targeting unit housing 28 and which can be selectively activated to rotate housing 28 about two substantially orthogonal axes. In particular, selected thrusters 82 can be fired to rotate targeting unit housing 28 about: (i) a first axis (represented in FIGS. 2 and 3 by dashed line 86) to adjust the yaw of targeting unit 22, and (ii) a second axis (represented in FIGS. 2 and 3 by dashed line 88) to adjust the pitch of targeting unit 22. In a preferred embodiment, thrusters 82 are positioned in a diametrically opposed array, and axes 86 and 88 each extend through the gravitational center of pyrotechnically-gimbaled targeting unit 22 (represented in FIGS. 2 and 3 by symbol 98). As a result of this structural configuration, diametrically opposed pairs of thrusters 82 can be simultaneously activated to rotate targeting unit housing 28 in an accurate and controlled manner without causing pyrotechnically-gimbaled targeting unit 22 to deviate from its prescribed launch path. This, in turn, allows pyrotechnically-gimbaled targeting unit 22 to perform pointing maneuvers with a high degree of precision; and, in embodiments wherein multiple countermeasure systems 20 are positioned laterally adjacent one another (described below in conjunction with FIGS. 5-7), this allows neighboring targeting units to be launched simultaneously without risk of cross-interference or collision. In a preferred embodiment, axes 86 and 88 are also substantially orthogonal to the payload deployment ray (represented by arrow 95 in FIG. 4), and axis 86 is substantially co-linear with the targeting unit launch ray (represented by arrow 56 in FIG. 1).

As noted above, pyrotechnic thrusters 82 are preferably mounted to targeting unit housing 28 in a diametrically opposed array. In the illustrated example, specifically, thrusters 82 are arranged into two circumferentially-spaced groups: (i) a first circumferentially-spaced thruster group 82(*a*) mounted through front face 36 and around payload opening 34 (shown in FIGS. 1 and 2); and (ii) a second circumferentially-spaced thruster group 82(*b*) mounted through a rear face 84 of targeting unit housing 28 (shown in FIG. 3). Dashed lines 90 shown in FIGS. 2 and 3 divide pyrotechnic thrusters 82(*a*) and 82(*b*) into four quadrants. During a given pointing maneuver, one or more of thrusters 82(*a*) in the left quadrant of FIG. 2 are preferably fired in unison with the diametrically opposed thrusters or thrusters 82(*b*) in the left quadrant of FIG. 3 to adjust the yaw of targeting unit 22 in a first rotational direction (e.g., yaw right). Conversely, one or more of thrusters 82(*a*) shown in the right quadrant of FIG. 2 are preferably fired in unison with the diametrically opposed thrusters or thrusters 82(*b*) in the right quadrant of FIG. 3 to adjust the yaw of targeting unit 22 in a second rotational direction (e.g., yaw left). In a similar manner, one or more of thrusters 82(*a*) in the upper quadrant of FIG. 2 are preferably fired in unison with the diametrically opposed thrusters or thrusters 82(*b*) in the upper quadrant of FIG. 3 to adjust the pitch of targeting unit 22 in a first rotational direction (e.g., pitch up). Finally, one or more of thrusters 82(*a*) in the lower quadrant of FIG. 2 are preferably fired in unison with the diametrically opposed thrusters or thrusters 82(*b*) shown in the lower quadrant of FIG. 3 to adjust the pitch of targeting unit 22 in a second rotational direction (e.g., pitch down).

Although the number of thrusters mounted to targeting unit 22 will vary amongst embodiments, a total of thirty two thrusters 82 are mounted to pyrotechnically-gimbaled targeting unit 22 in the illustrated example, with sixteen thrusters included in each thruster group 82(*a*) and 82(*b*). Notably, by equipping targeting unit 22 with more thrusters than required to perform an initial targeting maneuver, a number of thrusters can be held in reserve for subsequent activation should additional adjustments to the orientation of targeting unit 22 become necessary due to, for example, changes in the velocity or direction of an incoming projectiles; e.g., activation of a second stage booster included within a rocket propelled grenade.

Figure 4:
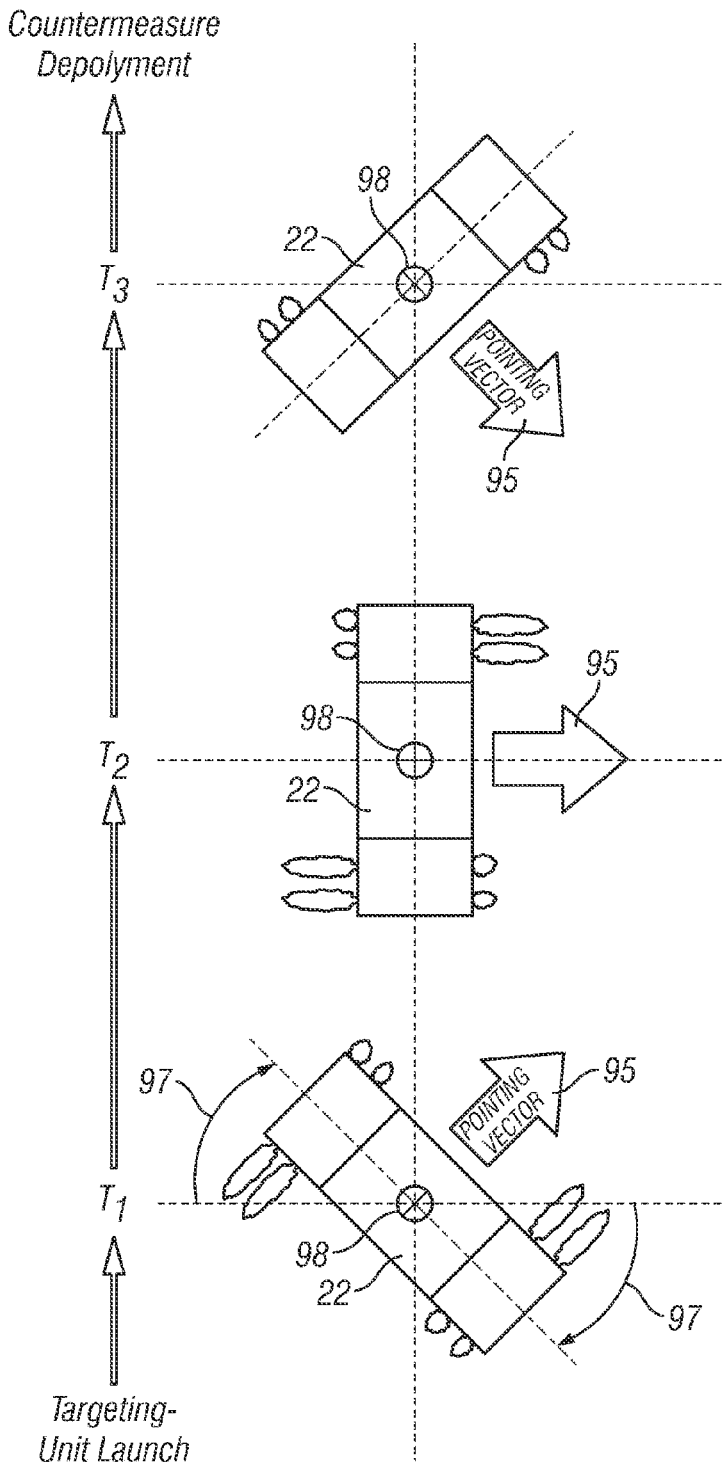
FIG. 4 is a schematic illustrating an exemplary thruster sequence that may be performed by the pyrotechnically-gimbaled targeting unit shown in FIGS. 1-3 after launch from the base launch unit shown in FIG. 1.

FIG. 4 illustrates an exemplary thruster activation sequence that may be performed to rotate pyrotechnically-gimbaled targeting unit 22 about a given axis to provide controlled pointing of countermeasure payload 30. The exemplary scenario illustrated in FIG. 4 occurs when pyrotechnically-gimbaled targeting unit 22 is airborne immediately after launch of targeting unit 22 from base launch unit 24. As can be seen in lower portion of FIG. 4, at time $T_1$ after targeting unit launch, at least one pair of diametrically-opposed thrusters include within thrusters 82 (identified FIGS. 1-3) are activated to initiate rotation of targeting unit 22 about the given axis (indicated in FIG. 4 by arrows 97). Subsequently, at time $T_2$, one or more opposing pairs of reverse thrusters included within thrusters 82 are then activated. The reverse thrusters continue to fire as the initially-activated thrusters burn-out (or are otherwise deactivated) thus exerting a counter-torque slowing the rotation of targeting unit 22. Finally, as illustrated in the upper portion of FIG. 4, the reverse thrusters burn-out (or are otherwise deactivated) at time $T_3$ and targeting unit 22 ceases rotation about the given axis. Payload deployment ray 95 has now rotated into the desired angular position, and countermeasure payload 30 (FIGS. 1 and 2) may be deployed to intercept and destroy the incoming threat. In addition, at time $T_3$, targeting unit 22 has traveled a sufficient distance away from (e.g., upward and outward from) the armored fighting vehicle to ensure that the vehicle is not damaged during payload deployment.

As indicated above, the timing of the above-described thruster activation sequence may be determined by intercept timing electronics deployed onboard the armored fighting vehicle. For example, intercept timing electronics may transmit command signals to a controller (not shown), which is included within pyrotechnically-gimbaled targeting unit 22 and operably coupled to each thruster 82. In a preferred embodiment, a physical data link may be provided between targeting unit housing 28 and external connector 26 (FIG. 1), which is operably coupled to intercept timing electronics when countermeasure system 20 is deployed onboard an armored fighting vehicle, to enable rapid data transmission to the targeting unit controller and to eliminate the possibility of a throughput bottleneck. In this regard, and referring once again to FIG. 1, a fiber optic tether 94 (e.g., a sheathed optical fiber bundle) can be connected between targeting unit housing 28 and external connector 26. Fiber optic tether 94 is provided with a length sufficient to remain attached to pyrotechnically-gimbaled targeting unit 22 throughout its flight; and, when targeting unit 22 is stowed within storage compartment 46 prior to launch, the excess length of fiber optic tether 94 can be stored within an annulus 96 provided within compartment 46. During operation of countermeasure system 20, fiber optic tether 94 enables high speed data transmission to pyrotechnically-gimbaled targeting unit 22 until deployment of countermeasure payload 30 thereby allowing the orientation of targeting unit 22 to be continually adjusted to accommodate changes in the velocity and/or direction of an incoming projectile.

As the foregoing has emphasized, countermeasure system 20 is well-suited for deployment onboard an armored fighting vehicle as an Active Protection System. Due to the unique ability of pyrotechnically-gimbaled targeting unit 22 to rotate to any direction in three dimensional space, a single countermeasure system 20 can provide an armored fighting vehicle with full hemispherical threat protection. It is generally desirable, however, to install multiple countermeasure systems 20 on a single armored fighting vehicle to provide comprehensive protection from tandem threats and multiple, simultaneously-presented threats. Advantageously, countermeasure system 20 is relatively compact and consequently well-suited for deployment onboard an armored fighting vehicle in a densely-packed group with similar countermeasure systems. Furthermore, in embodiments wherein the rotational axes of pyrotechnically-gimbaled targeting unit 22 extend through the targeting unit's center of gravity, neighboring targeting units can be simultaneously launched and gimbaled when airborne without risk of collision. In a preferred embodiment, multiple countermeasure systems 20 are mounted to a vehicle in a side-by-side or laterally adjacent arrangement utilizing, for example, a canted launch rack of the type described below in conjunction with FIGS. 5-7.

Figure 6:
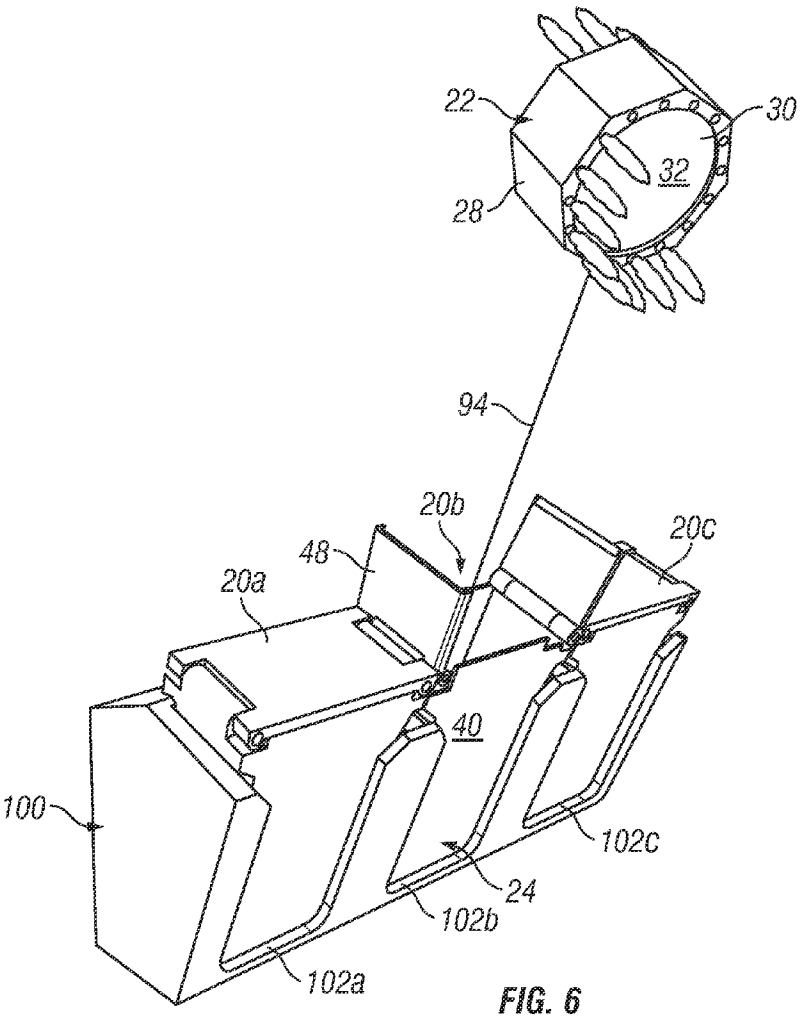
FIG. 6 is an isometric view of the canted launch rack and countermeasure systems shown in FIG. 5 illustrating a targeting unit during pyrotechnic gimbaling.
Figure 5:
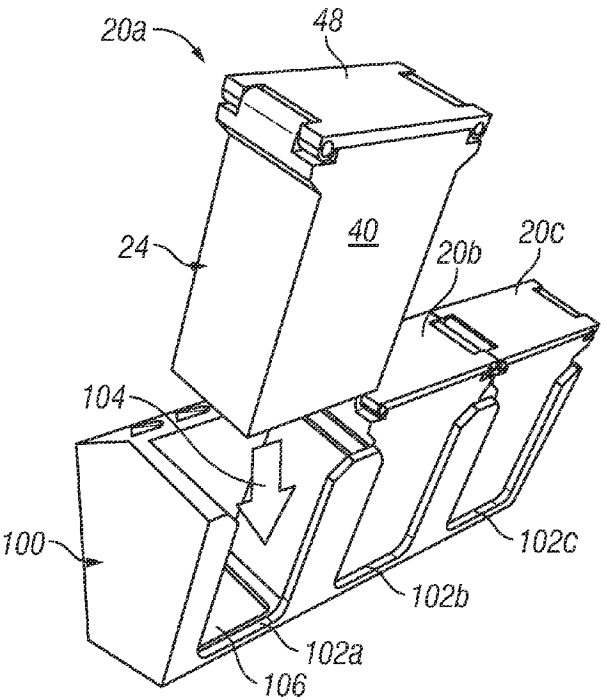
FIG. 5 is an isometric view of a canted launch rack that may be utilized to mount a plurality of countermeasure systems, including the countermeasure system shown in FIGS. 1-4, to an armored fighting vehicle.

FIGS. 5 and 6 are isometric views of an exemplary canted launch rack 100 that can be utilized to secure a plurality of countermeasure systems 20(*a*)-20(*c*) to an armored fighting vehicle. With initial reference to FIGS. 5 and 6, canted launch rack 100 includes three stalls 102(*a*), 102(*b*), 102(*c*) into which the canister body 40 of a given countermeasure system 20 can be loaded (indicated in FIG. 5 by arrow 104). In embodiments wherein each countermeasure system 20 includes an external connector (e.g., connector 26 shown in FIG. 1), the connector engages a corresponding connector (not shown) exposed through a lower opening 106 provided in each stall 102(*a*), 102(*b*) and 102(*c*). When an incoming threat is detected, a given countermeasure system 20 may be utilized to defeat the incoming threat in the above-described manner That is, a pyrotechnically-gimbaled targeting unit 22 may be launched through the scored canister lid 48, as illustrated in FIG. 6; the targeting unit 22 may then be pyrotechnically-gimbaled to point countermeasure payload 30 toward the incoming threat, as further illustrated in FIG. 6; and the countermeasure payload 30 may subsequently be deployed to intercept and destroy the incoming missile prior to vehicle impact. Notably, after deployment of a given countermeasure payload 30 and the corresponding destruction of targeting unit 22, the remaining base launch unit 24 may simply be removed from its stall 102 and replaced with a new countermeasure system 20.

Figure 7:
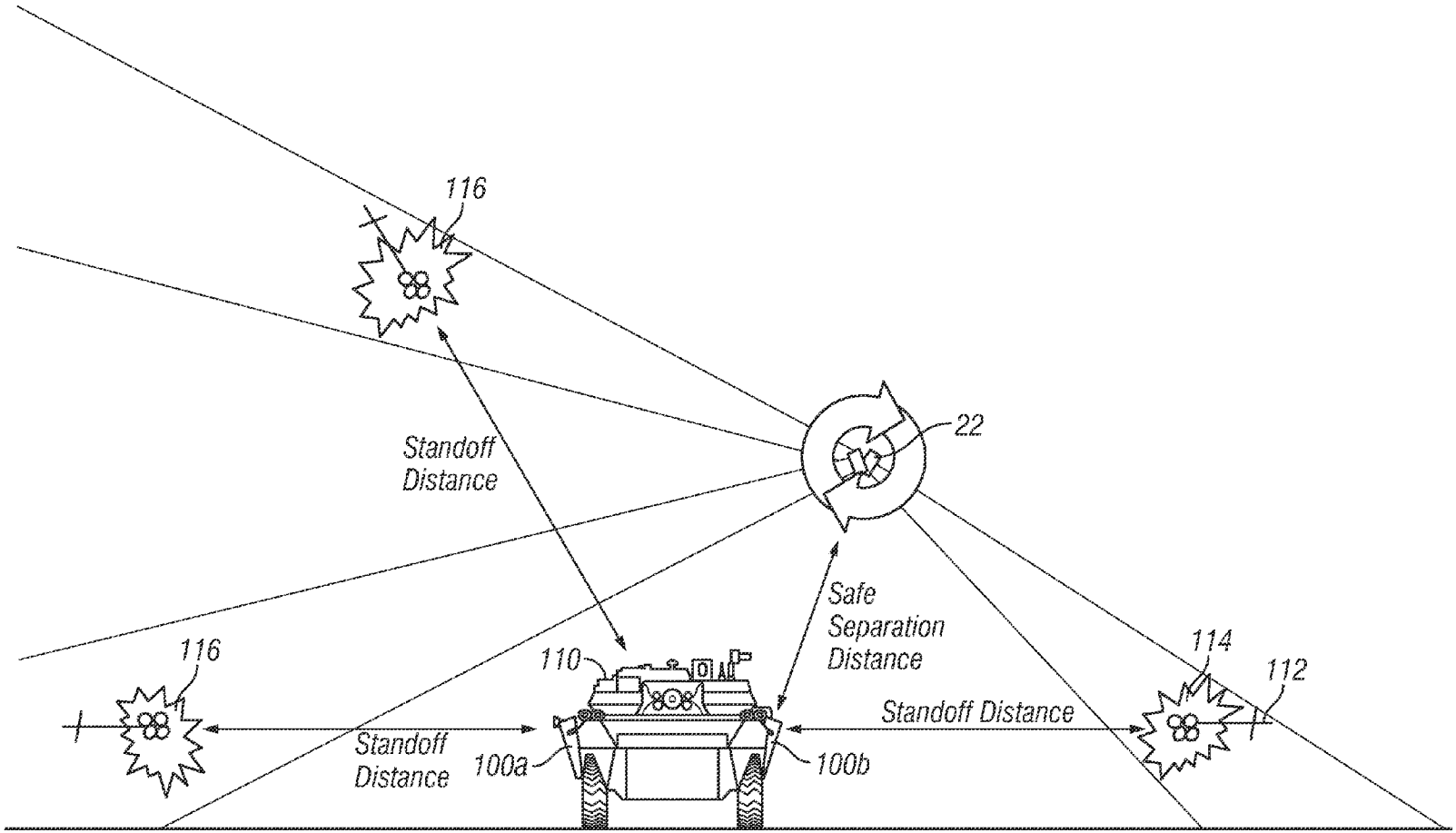
FIG. 7 is a front view of an armored fighting vehicle having the canted launch rack and the countermeasures systems shown in FIGS. 5 and 6 mounted to each side thereof.

The canted orientation of launch rack 100 allows pyrotechnically-gimbaled targeting unit 22 to reach a relatively safe separation distance from the armored fighting vehicle prior to the deployment of the countermeasure payload in an extremely abbreviated time period. In addition, the canted orientation of launch rack 100, in combination with the frontward positioned payload on the pyrotechnically gimbaled targeting unit, allows pyrotechnically-gimbaled targeting unit 22 to be pointed toward an incoming projectile with little to no gimbaling in many common engagement scenarios wherein a rocket propelled grenade or other missile is launched toward the armored fighting vehicle's side from an elevation at or near ground level. This may be more fully appreciated by referring to FIG. 7, which illustrates an armored fighting vehicle 110 having two launch racks 100(*a*) and 100(*b*) mounted to its opposing sides and each supporting a countermeasure system. As shown in FIG. 7, when an incoming missile 112 is launched toward the side of armored fighting vehicle 110 from a near-ground level elevation, a pyrotechnically-gimbaled targeting unit 22 can be rapidly launched from launch rack 100(*b*) and, when airborne, deploy its countermeasure payload to destroy incoming missile 112 at a predetermined standoff distance without significant in-air gimbaling of targeting unit 22 (illustrated in FIG. 7 at 114). As a result, the countermeasure system can effective defeat the incoming missile prior to vehicle impact, even when the missile is launched in close proximity to the armored fighting vehicle. In addition, as described in detail above, the pyrotechnically-gimbaled targeting unit 22 can be gimbaled when airborne to defeat missiles fired at the armored fighting vehicle from virtually any direction, as further indicated in FIG. 7 at 116. Consequently, when deployed onboard an armored fighting vehicle, such as vehicle 110 shown in FIG. 7, the countermeasure systems provide the vehicle with complete hemispherical threat protection again tandem threats, multiple threats, and projectiles (e.g., rocket propelled grenades) launched in close proximity to the host vehicle.

The foregoing has thus provided embodiments of a countermeasure system that is scalable, compact, relatively lightweight, modular, and relatively inexpensive to manufacture and deploy onboard armored fighting vehicles or other platforms. In the above-described exemplary embodiments, the countermeasure system employs components, such as a gas generator, pyrotechnic thrusters, and a shaped charge warhead, which have proven reliable when utilized in other applications and devices. As a primary advantage, the above-described exemplary countermeasure systems provides full hemispherical protection against incoming threats, including multiple threats, tandem threats, and RPGs launched in close proximity to the armored fighting vehicle. The foregoing has also provided embodiments of a method for equipping a vehicle such as an armored fighting vehicle, with at least one countermeasure system utilizing a canted launch rack. For example, in embodiments, the method includes the steps of mounting a canted launch rack to the vehicle, and securing a first base launch unit containing a pyrotechnically-gimbaled targeting unit to the canted launch rack. The method may also include the step of securing a second base launch unit to the canted launch rack laterally adjacent the first base launch unit.

Although primarily described above as an Active Protection System utilized to defeat incoming missiles, it should be appreciated that embodiments of the countermeasure system can also be utilized as a light skin armor penetrator to provide, for example, a vehicle barrier at a roadside checkpoint in military or civilian (e.g., homeland security) contexts. Embodiments of the countermeasure system can also be palletized and/or utilized to support infantry. In the latter regard, embodiments of the countermeasure system can be equipped with a global positioning system and/or network capability and serve as an intelligent claymore useful in perimeter defense, network ambush, and similar combat scenarios. In still further embodiments, the countermeasure system may be remotely controlled by military personnel utilizing a handheld communication unit.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A pyrotechnically-gimbaled targeting unit, comprising:

a targeting unit housing;

a countermeasure payload carried by the targeting unit housing; and a plurality of thrusters coupled to the targeting unit housing and configured to be selectively activated to rotate the targeting unit housing about first and second substantially orthogonal axes to provide controlled pointing of the countermeasure payload prior to the deployment thereof;

wherein the pyrotechnically-gimbaled targeting unit is configured to be launched from a base launch unit including a storage compartment; and wherein the targeting unit housing is configured to sealingly engage the base launch unit when the pyrotechnically-gimbaled targeting unit is received within the storage compartment.

2. A pyrotechnically-gimbaled targeting unit according to claim 1, wherein the first and second substantially orthogonal axes each extend through the approximate center of gravity of the pyrotechnically-gimbaled targeting unit.

3. A pyrotechnically-gimbaled targeting unit according to claim 1, wherein the plurality of thrusters is substantially diametrically opposed.

4. A pyrotechnically-gimbaled targeting unit according to claim 1, wherein the countermeasure payload is configured to be deployed along a payload deployment ray, and wherein the first and second substantially orthogonal axes are substantially orthogonal to the payload deployment ray.

5. A pyrotechnically-gimbaled targeting unit according to claim 1, wherein the countermeasure payload is configured to be deployed along a payload deployment ray, and wherein the plurality of thrusters comprises:

a first circumferentially-spaced thruster group mounted to the targeting unit housing and generally pointing in the same direction as does the payload deployment ray; and a second circumferentially-spaced thruster group mounted to the targeting unit housing and generally pointing in a direction opposite the payload deployment ray.

6. A pyrotechnically-gimbaled targeting unit according to claim 5 wherein the first circumferentially-spaced thruster group is substantially co-axial with the payload deployment ray.

7. A pyrotechnically-gimbaled targeting unit according to claim 1, wherein the countermeasure payload comprises a Multiple Explosively Formed Projectile warhead.

8. A pyrotechnically-gimbaled targeting unit according to claim 1, wherein the targeting unit housing comprises a front face having an opening therethrough, and wherein the countermeasure payload comprises a fragmentation liner exposed through the opening.

9. A pyrotechnically-gimbaled targeting unit according to claim 8 wherein a first group of thrusters included within the plurality of thrusters are circumferentially-spaced around the opening.

10. A pyrotechnically-gimbaled targeting unit according to claim 1, wherein the plurality of thrusters include pyrotechnic elements for rotating the pyrotechnically-gimbaled targeting unit in any direction about a center of gravity of the pyrotechnically-gimbaled targeting unit.

11. A pyrotechnically-gimbaled targeting unit according to claim 1, further including a controller for selectively activating the plurality of thrusters.

12. A countermeasure system, comprising:

a pyrotechnically-gimbaled targeting unit;

a countermeasure payload carried by the pyrotechnically-gimbaled targeting unit; and a base launch unit from which the pyrotechnically-gimbaled targeting unit is configured to be launched prior to deployment of the countermeasure payload;

wherein the pyrotechnically-gimbaled targeting unit includes:

a targeting unit housing; and a plurality of diametrically opposed thrusters coupled to the targeting unit housing and configured to be selectively activated to adjust the pitch and yaw of the targeting unit housing after launch of the pyrotechnically-gimbaled targeting unit; and wherein the base launch unit includes:

a canister body having a storage compartment in which the pyrotechnically-gimbaled targeting unit is stored prior to launch; and a canister cover coupled to the canister body.

13. A countermeasure system according to claim 12 wherein the pyrotechnically-gimbaled targeting unit is configured to be launched through the canister cover.

14. A countermeasure system according to claim 12 wherein the pyrotechnically-gimbaled targeting unit sealingly engages at least one inner wall of the canister body when the pyrotechnically-gimbaled targeting unit is stored within the storage compartment to define a pressurizable launch chamber.

15. A countermeasure system according to claim 14 further comprising a pressurized gas source configured to supply pressurized gas to the pneumatic launch chamber to launch the pyrotechnically-gimbaled targeting unit from the storage compartment.

16. A countermeasure system according to claim 15 wherein the pressurized gas source comprises a gas generator.

17. A countermeasure system according to claim 12 further comprising a fiber optic tether coupled between the pyrotechnically-gimbaled targeting unit and the base launch unit.

* * * * *